US006623082B1

(12) United States Patent
Huang

(10) Patent No.: US 6,623,082 B1
(45) Date of Patent: Sep. 23, 2003

(54) GROUND-CONTACTING BLOCK STRUCTURE OF A CHAIR

(76) Inventor: Tsung-Chieh Huang, No. 1, Ta Yo 2 Street, Ta Fa Industrial District, Kaohsiung Hsien (TW)

( * ) Notice: Subject to any disclaimer, the term of this patent is extended or adjusted under 35 U.S.C. 154(b) by 0 days.

(21) Appl. No.: 10/145,623

(22) Filed: May 10, 2002

(51) Int. Cl.[7] ..... A47C 31/00
(52) U.S. Cl. ..... 297/463.1
(58) Field of Search ..... 297/463.1, 463.2; 248/188.9, 188.8, 188.4, 188.2, 188.1; 16/42 R, 42 T

(56) References Cited

U.S. PATENT DOCUMENTS 1,123,959 A * 1/1915 Von Der Lin
1,367,922 A * 2/1921 Ramsey
1,798,272 A * 3/1931 Phillips
3,186,025 A * 6/1965 Kesterton
3,342,445 A * 9/1967 Bouwkamp
3,389,421 A * 6/1968 Wheeler
4,979,786 A * 12/1990 Kuraseko
5,170,972 A * 12/1992 Casals Guell
5,191,676 A * 3/1993 Gerner
5,242,141 A * 9/1993 Chester
6,478,270 B2 * 11/2002 Parisi et al.

* cited by examiner

*Primary Examiner*—Milton Nelson, Jr.
(74) *Attorney, Agent, or Firm*—Pro-Techtor Inter-National Services

(57) ABSTRACT

Ground-contacting block structure of a chair for preventing the chair leg from scraping wooden floorboard and other high glass floorboards. The ground-contacting block is designed with different patterns respectively for fixing under bottom end of a column-type chair leg and latching under the transverse beam of a U-shaped chair leg. The ground-contacting block is composed of a mother pad and a daughter pad which are made of two different materials with different elastic coefficients. The mother pad is fixedly connected with the chair leg. The daughter pad is assembled with the mother pad and protrudes from the bottom of the mother pad. The daughter pad is resiliently softer than the mother pad. Therefore, the chair legs can more stably and silently contact with the ground without scraping or wearing the floorboard.

4 Claims, 6 Drawing Sheets

GROUND-CONTACTING BLOCK STRUCTURE OF A CHAIR

BACKGROUND OF THE INVENTION

The present invention is related to an improved ground-contacting block structure of a chair for preventing the chair leg from scraping or wearing floorboard.

A chair such as office chair, leisure chair, dining chair, etc. has legs in contact with the ground. The legs of the chair can be divided into two types. One is column-type leg the bottom end of which is supported on the ground. The other is U-shaped leg in which a transverse beam contacts with the ground. These chair legs are equipped with different pad blocks in contact with the ground. With respect to the column-type chair leg, the pad block is directly disposed under the bottom end of the chair leg. With respect to the U-shaped chair leg, a U-shaped pad block is fitted under the transverse beam of the chair leg. The conventional pad block is made of hard plastic material. To wooden floorboard or other floorboard made of weaker hardness, the floorboard is likely to be scraped and worn due to drawing of the chair. Some pad blocks of the chair legs are made of soft material. However, such soft material can be hardly firmly fixed on the chair leg so that the pad block tends to detach from the chair leg and miss and it is necessary for a user to buy another pad block. However, it is quite troublesome to solely buy a pad block of the chair leg so that the user often leaves the chair legs with unified lengths. In the case that the soft pad block is fixed on the chair leg by a screw or the like, it will be impossible to quickly complete the assembling procedure without using hand tool and the cost for the product will be increased due to the screws. Therefore, most of the existent chair leg pad blocks are still made of hard material which is easy to scrape the floorboard.

SUMMARY OF THE INVENTION

It is therefore a primary object of the present invention to provide an improved ground-contacting block structure of a chair, which will not scrape or wear wooden floorboard.

It is a further object of the present invention to provide the above ground-contacting block structure of a chair, which is widely applicable to stone and wooden floorboards and other floorboards made of other materials, whereby the using sites of the chair are not limited.

It is still a further object of the present invention to provide the above ground-contacting block structure of a chair, which is composed of a mother pad and a daughter pad which are made of two different materials with different elastic coefficients. The mother pad and daughter pad can be easily assembled without using any hand tool.

It is still a further object of the present invention to provide the above ground-contacting block structure of a chair, in which the daughter pad is resiliently softer than the mother pad and contacts with the ground. Therefore, the chair legs can more stably and silently contact with the ground.

The present invention can be best understood through the following description and accompanying drawings wherein:

DETAILED DESCRIPTION OF THE PREFERRED EMBODIMENTS

Figure 1:
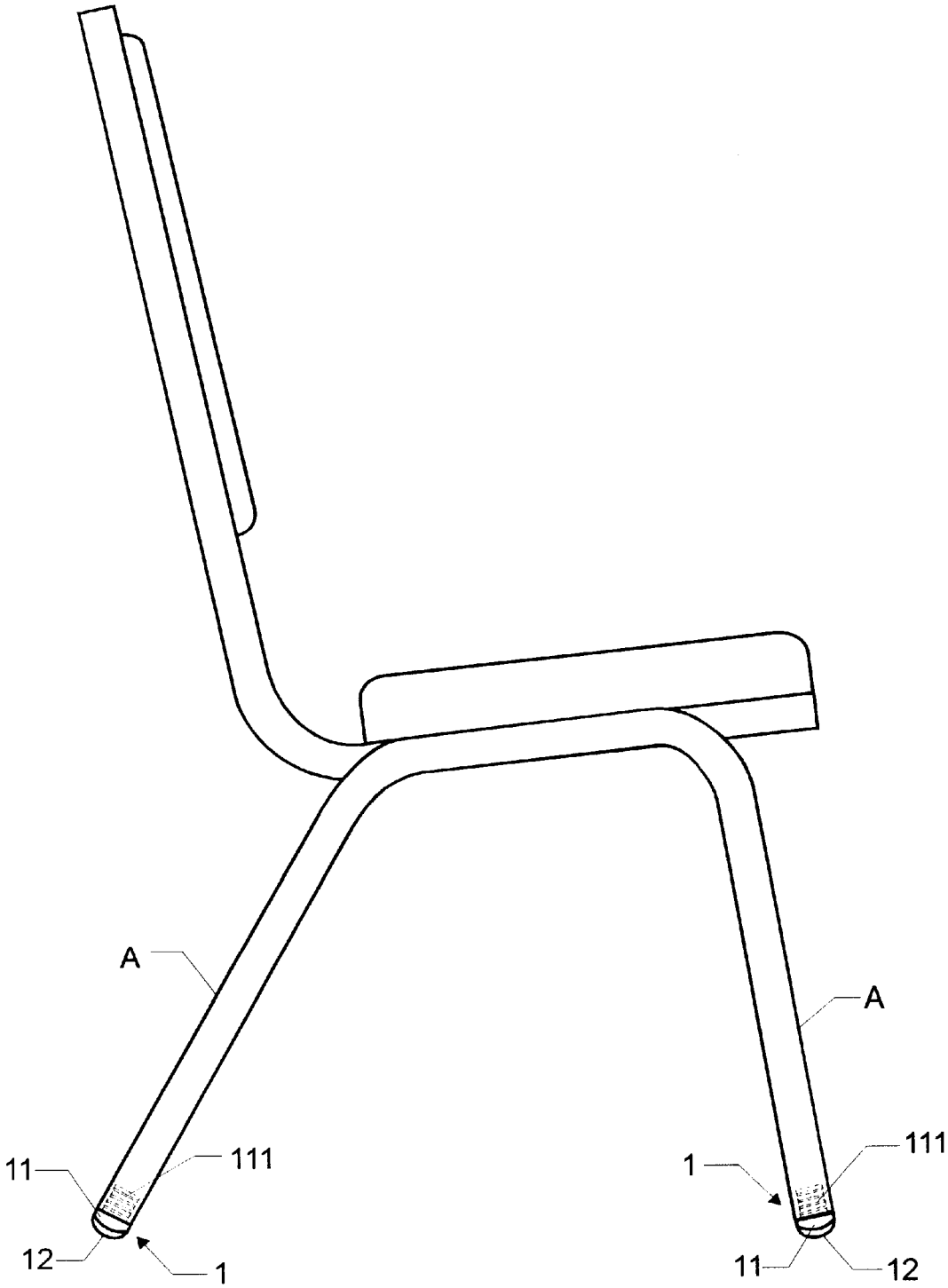
FIG. 1 is a view showing the application of a first embodiment of the ground-contacting block of the present invention.
Figure 5:
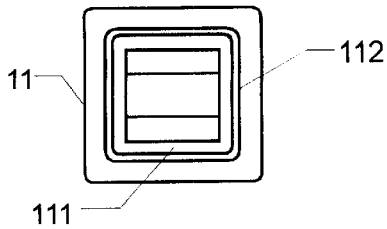
FIG. 5 is a top view according to FIG. 2.
Figure 12:
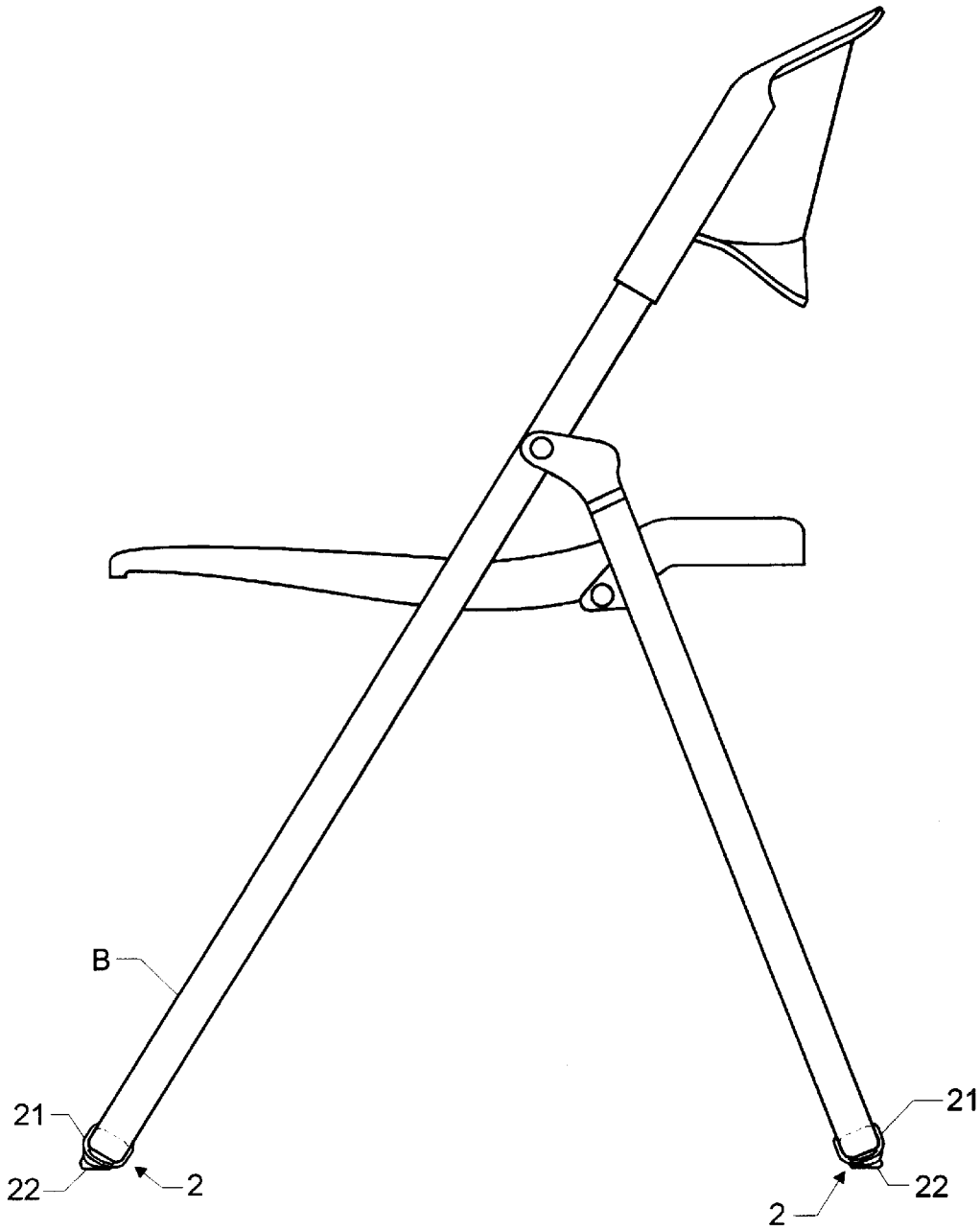
FIG. 12 is a view showing the application of a second embodiment of the ground-contacting block of the present invention.
Figure 16:
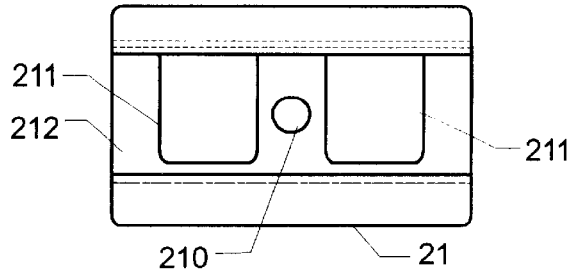
FIG. 16 is a top view according to FIG. 13.
Figure 14:
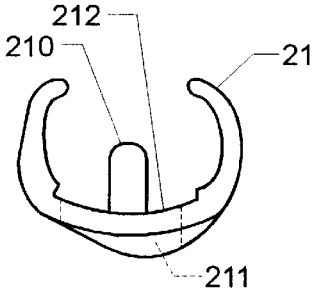
FIG. 14 is a left view according to FIG. 13.
Figure 13:
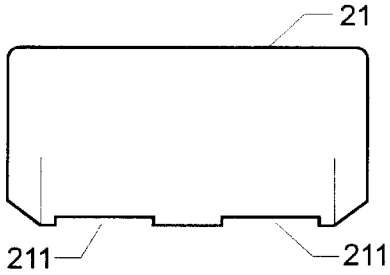
FIG. 13 is a front view of the mother pad of the second embodiment of the ground-contacting block of the present invention.
Figure 15:
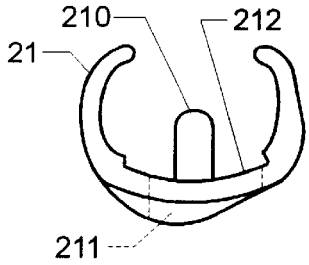
FIG. 15 is a right view according to FIG. 13.
Figure 17:
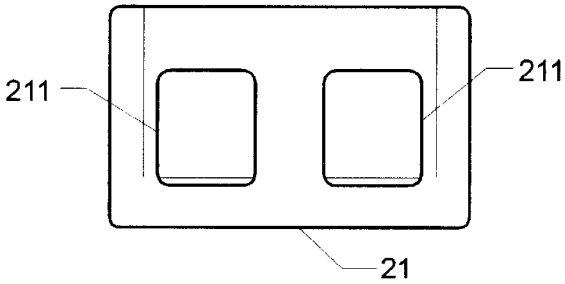
FIG. 17 is a bottom view according to FIG. 13.
Figure 20:
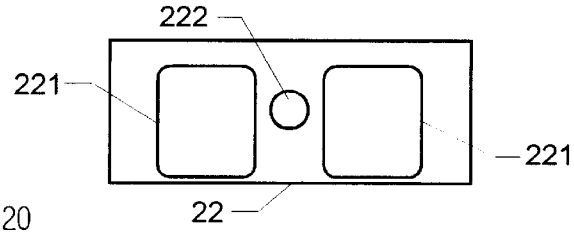
FIG. 20 is a top view according to FIG. 18.
Figure 18:
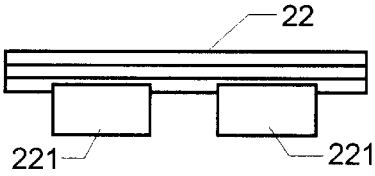
FIG. 18 is a front view of the daughter pad of the second embodiment of the ground-contacting block of the present invention.
Figure 19:
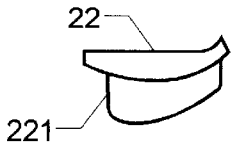
FIG. 19 is a right view according to FIG. 18.
Figure 21:
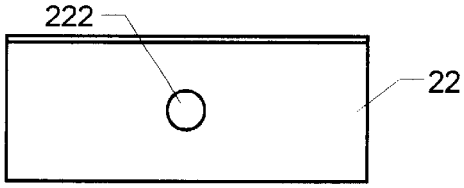
FIG. 21 is a bottom view according to FIG. 18.

FIGS. 1 and 12 respectively show two embodiments of the ground-contacting block structure of a chair of the present invention. FIG. 1 shows a ground-contacting block 1 for column, type chair leg, while FIG. 12 shows a ground-contacting block 2 for transverse beam of U-shaped chair leg. The ground-contacting blocks 1 and 2 are made of two different materials with different elastic coefficients.

Figure 3:
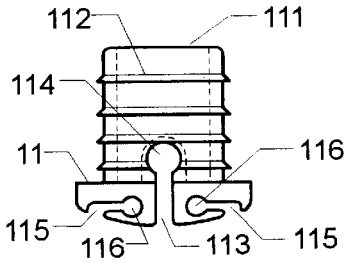
FIG. 3 is a left view according to FIG. 2.
Figure 2:
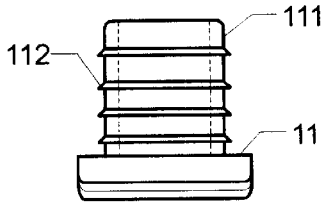
FIG. 2 is a front view of the mother pad of the first embodiment of the ground-contacting block of the present invention.
Figure 4:
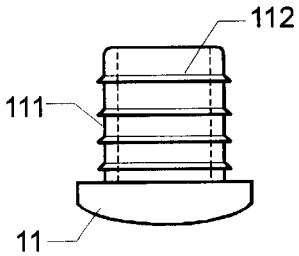
FIG. 4 is a right view according to FIG. 2.
Figure 6:
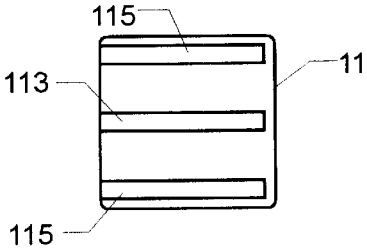
FIG. 6 is a bottom view according to FIG. 2.
Figure 10:
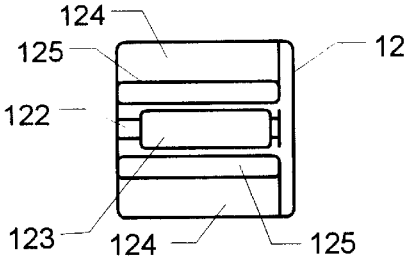
FIG. 10 is a top view according to FIG. 7.
Figure 8:
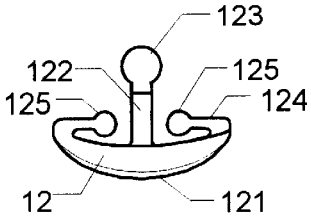
FIG. 8 is a left view according to FIG. 7.
Figure 7:
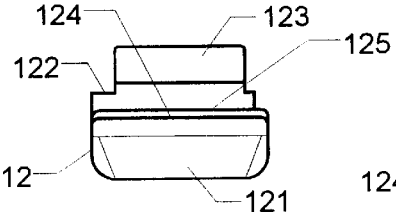
FIG. 7 is a front view of the daughter pad of the first embodiment of the ground-contacting block of the present invention.
Figure 9:
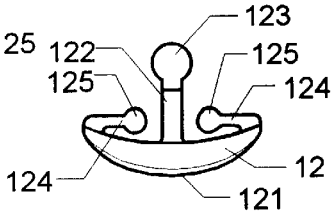
FIG. 9 is a right view according to FIG. 7.
Figure 11:
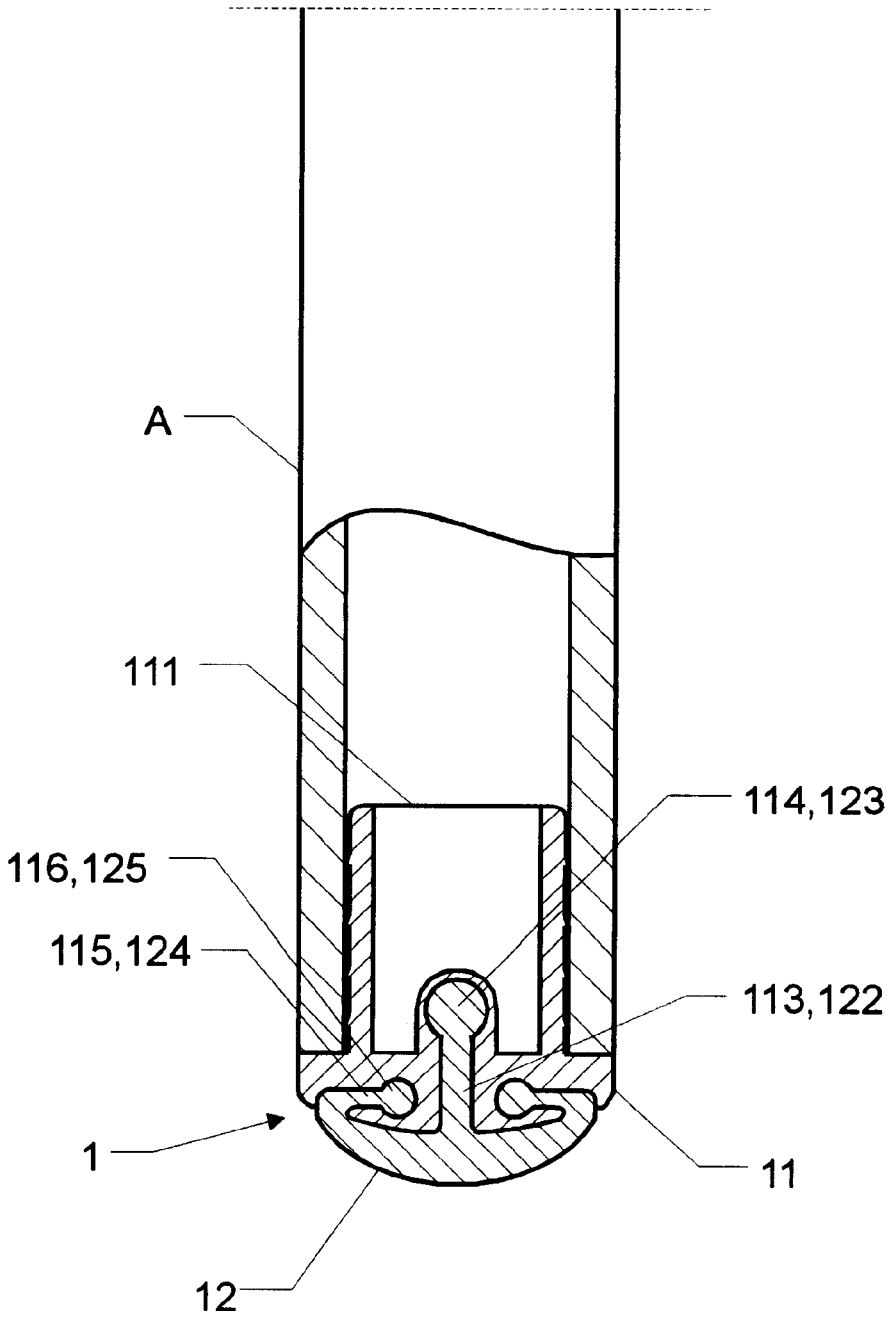
FIG. 11 is a sectional assembled view of the first embodiment of the ground-contacting block of the present invention.

Please refer to FIGS. 1 to 11. The ground-contacting block 1 for column-type chair leg includes a mother pad 11 connecting with the chair leg A and a daughter pad 12 connecting with the mother pad 11. The mother pad 11 has an upper connecting section 111 for connecting with the chair leg A. Several anti-detachment racket ribs 112 are formed on outer circumference of the connecting section 111, whereby the mother pad 11 can be fixedly plugged into the end of the chair leg A. The bottom of the mother pad 11 is formed with an assembling split 113 open to lower side and a lateral side. The inner top end of the assembling split 113 is formed with an insertion groove 114. The inner diameter of the insertion groove 114 is larger than the width of the assembling split 113. The insertion groove 114 communicates with the assembling split 113 and is open to the same lateral side for easily assembling with.the daughter pad 12. In addition, horizontal latch grooves 115 are respectively formed on two sides of the lower opening of the assembling split 113 in reverse directions. The inner end of each latch groove 115 is formed with an insertion groove 116. The inner diameter of the insertion groove 116 is larger than the width of the latch groove 115. The latch groove 115 approximately 90 degrees turns and has an opening facing downward and communicating with bottom side of the mother pad 11. The horizontal latch grooves 115 and the insertion grooves 116 communicate with each other and are open to the same lateral side as the assembling split 113 (as shown in FIGS. 3 and 6).

Please refer to FIGS. 7 to 10 which show the daughter pad 12 of FIG. 1. The bottom of the daughter pad 12 is formed with an arch ground-contacting face 121. An insertion board 122 is disposed on upper side of the daughter pad 12 for laterally inserting into the assembling split 113 of the mother pad 11. The top end of the insertion board 122 is formed with a bulged insertion bar 123 for inserting into the insertion groove 114 of the mother pad 11. In addition, two horizontal latch boards 124 are formed on two sides of upper face of the daughter pad 12 for laterally inserting into the horizontal latch grooves 113 of the mother pad 11. The free end of each latch board 124 is formed with a bulged insertion bar 125 for inserting into the insertion groove 116 of the latch groove 115 of the mother pad 11. Accordingly, the mother pad 11 and the daughter pad 12 can be vertically and horizontally latched and assembled with each other. Therefore, the mother pad 11 and the daughter pad 12 can be firmly associated without detachment.

According to the above arrangement, the ground-contacting block can be connected with the chair leg without using any hand tool. Moreover, the softer daughter pad 12 contacts with the floorboard so as not to scrape or wear the same. Also, the four legs of the chair can more stably and silently contact with the ground. Such ground-contacting block is applicable to all the column-type (tube or rod) chair legs.

FIGS. 12 to 22 show the ground-contacting block for U-shaped chair leg. The ground-contacting block 2 includes a mother pad 21 for connecting with the transverse beam B1 of the U-shaped chair leg B and a daughter pad 22 for connecting with the mother pad 21. As shown in FIGS. 13 to 17, the mother pad 21 is a C-shaped pad member having an opening facing upward. An engaging post 210 is disposed in the mother pad 21 for inserting into an engaging hole B2 formed on the transverse beam B1. The bottom of the mother pad 21 is formed with at least or over one perforation 211 and a downward recessed face 212 for the daughter pad 22 to hide therein. Referring to FIGS. 18 to 21, the bottom of the daughter pad 22 is formed with at least or over one ground-contacting face 221 for passing through and downward protruding from the perforation 211 of the mother pad 21. The daughter pad 22 is located in the downward recessed face 212 of the mother pad 21. The daughter pad 22 is formed with a through hole 222 for the engaging post 210 of the mother pad 21 to extend through the through hole 222.

Figure 22:
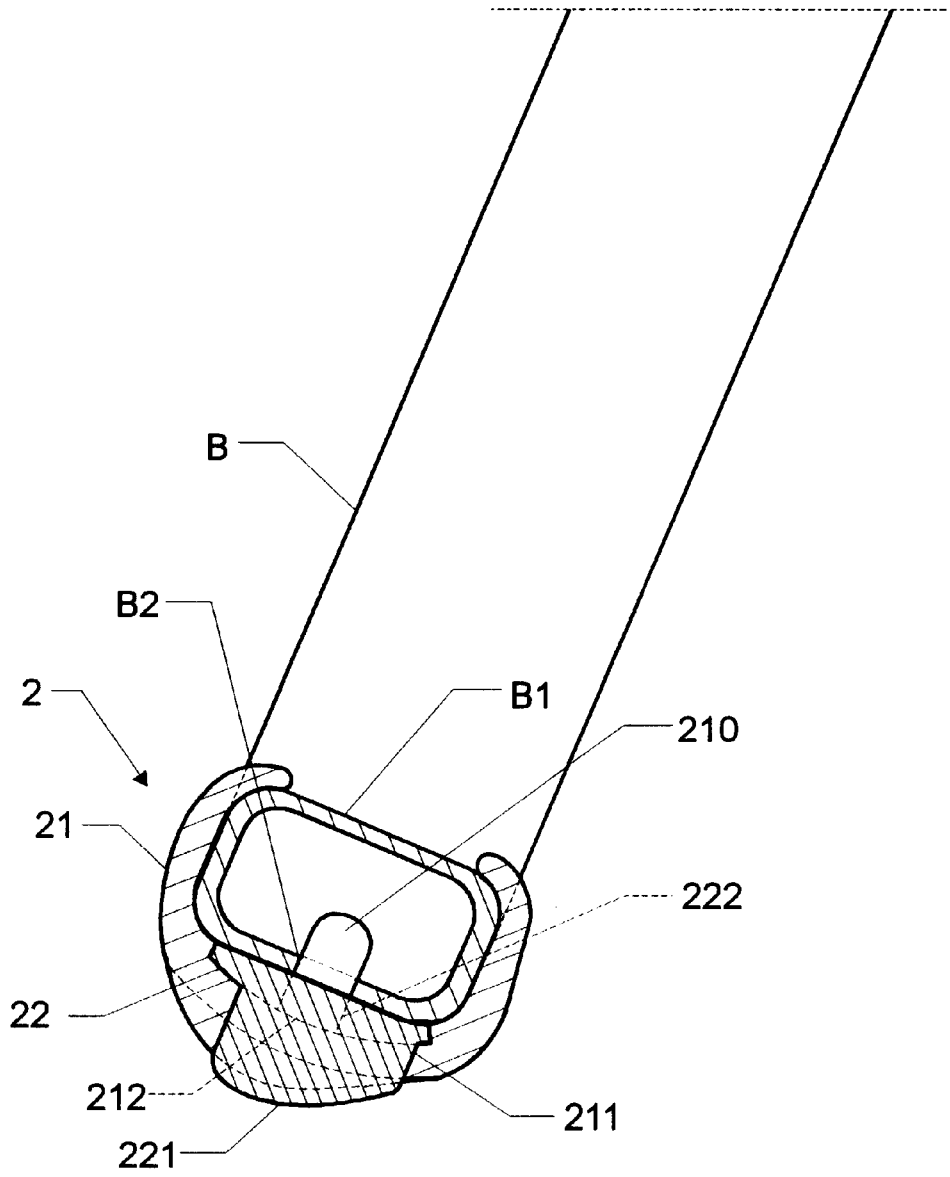
FIG. 22 is a sectional assembled view of the second embodiment of the ground-contacting block of the present invention.

The mother pad and daughter pad which are made of materials with different elastic coefficients can be assembled without using any hand tool and fixed on a predetermined portion of the transverse beam of the U-shaped chair leg (as shown in FIGS. 12 and 22). The soft daughter pad is firmly clamped between the transverse beam and the mother pad without detachment and scraping or wearing the floorboard. The legs of the chair can more stably and silently contact with the ground. Such ground-contacting block is applicable to all the chair legs with the transverse beam contacting with the ground.

The above embodiments are only used to illustrate the present invention, not intended to limit the scope thereof. Many modifications of the above embodiments can be made without departing from the spirit of the present invention.

What is claimed is:

1. Ground-contacting block structure of a chair, the ground-contacting block being composed of a mother pad and a daughter pad which are made of two different materials with different elastic coefficients, the mother pad being connected with a bottom end of a tubular column-type chair leg, the daughter pad being connected with the mother pad, a ground-contacting face of the daughter pad downward protruding from the bottom of the mother pad, wherein:

the mother pad has an upper connecting section for connecting with the chair leg, anti-detachment ratchet ribs being formed on an outer circumference of the connecting section, the bottom of the mother pad being formed with an assembling split open to a lower side and a lateral side, an inner top end of the assembling split being formed with an insertion groove, an inner diameter of the insertion groove being larger than the width of the assembling split, the insertion groove communicating with the assembling split and being open to the same lateral side, horizontal latch grooves being respectively formed on two sides of the lower opening of the assembling split in reverse directions, an inner end of each latch groove being formed with an insertion groove, an inner diameter of the insertion groove being larger than the width of the latch groove, the latch groove approximately 90 degrees turning and having an opening facing downward and communicating with a bottom side of the mother pad, the horizontal latch grooves and the insertion grooves communicating with each other and being open to the same lateral side as the assembling split; and the bottom of the daughter pad is formed with an arch ground-contacting face, an insertion board being disposed on an upper side of the daughter pad for laterally inserting into the assembling split of the mother pad, the top end of the insertion board being formed with a bulged insertion bar for inserting into the insertion groove of the mother pad, horizontal latch boards being formed on two sides of upper face of the daughter pad, a free end of each latch board being formed with a bulged insertion bar.

2. Ground-contacting block structure of a chair as claimed in claim 1, wherein the daughter pad is resiliently softer than the mother pad.

3. Ground-contacting block structure of a chair, the ground-contacting block being composed of a mother pad and a daughter pad which are made of two different materials with different elastic coefficients, the mother pad being connected with a transverse beam of a bottom of a U-shaped chair leg, the daughter pad being connected with the mother pad, a ground-contacting face of the daughter pad downward protruding from the bottom of the mother pad, wherein:

the mother pad is a C-shaped pad member having an opening facing upward, an engaging post being disposed in the mother pad for inserting into an engaging hole formed on the transverse beam of the chair leg, the bottom of the mother pad being formed with at least or over one perforation and a downward recessed face for the daughter pad to hide therein; and the bottom of the daughter pad is formed with at least or over one ground-contacting face for passing through and downward protruding from the perforation of the mother pad, the daughter pad being located in the downward recessed face of the mother pad, the daughter pad being formed with a through hole for the engaging post of the mother pad to extend through the through hole.

4. Ground-contacting block structure of a chair as claimed in claim 3, wherein the daughter pad is resiliently softer than the mother pad.

* * * * *